US006588611B1

(12) United States Patent
Krueger-Beuster

(10) Patent No.: US 6,588,611 B1
(45) Date of Patent: Jul. 8, 2003

(54) BRIDGE CRANE, ESPECIALLY A CONTAINER-LOADING BRIDGE

(75) Inventor: Helmut Krueger-Beuster, Ahrensburg (DE)

(73) Assignee: ABCranesSolutions GmbH, Zingst (DE)

( * ) Notice: Subject to any disclaimer, the term of this patent is extended or adjusted under 35 U.S.C. 154(b) by 0 days.

(21) Appl. No.: 10/009,240

(22) PCT Filed: Jun. 7, 2000

(86) PCT No.: PCT/DE00/01842

§ 371 (c)(1),
(2), (4) Date: Apr. 22, 2002

(87) PCT Pub. No.: WO00/76900

PCT Pub. Date: Dec. 21, 2000

(30) Foreign Application Priority Data

Jun. 9, 1999 (DE) ..... 199 26 182

(51) Int. Cl.[7] ..... B66C 17/00

(52) U.S. Cl. ..... 212/316; 104/98; 212/312; 212/325

(58) Field of Search ..... 212/312, 316, 212/325; 198/802; 104/91, 98

(56) References Cited

U.S. PATENT DOCUMENTS 1,111,100 A * 9/1914 Sawyer
1,206,226 A * 12/1916 Schilling
1,327,071 A * 1/1920 Taylor
1,481,404 A * 1/1924 Wright
1,765,118 A * 6/1930 Abriani
2,975,727 A * 3/1961 Kokoras
3,365,052 A * 1/1968 Kornylak
3,696,947 A * 10/1972 Ponsen ..... 214/14
3,700,128 A * 10/1972 Noble et al. ..... 214/40
4,602,566 A * 7/1986 Kernkamp et al. ..... 104/91
4,706,570 A * 11/1987 Moro et al. ..... 105/163.2

FOREIGN PATENT DOCUMENTS

DE 197 03 282 A1 8/1998
DE 197 03 282 * 8/1998

* cited by examiner

*Primary Examiner*—Thomas J. Brahan
(74) *Attorney, Agent, or Firm*—Larson & Larson, P.A.; James E. Larson

(57) ABSTRACT

A bridge crane, especially a container loading bridge, having a portal, a boom, a track system laid on the boom and crane trolleys which travel on the tracks, in which the track system comprises a working track, whose two rails have a mutual spacing corresponding to the wide spacing of the running wheels of the crane trolleys in a working position and a return track, whose rails have a mutual spacing corresponding to the narrow spacing of the running wheels of the crane trolleys in a return position is provided. Two arched pieces are arranged about the area of the ends of the boom where the working track and return track meet. The two wheel suspension mechanisms of the crane trolleys are constructed so as to rotate freely about a vertical axis. The two rotation axes of the crane trolleys are arranged with a spacing with respect to the longitudinal axis thereof corresponding to half the mutual spacing of the two rails of the return track.

12 Claims, 1 Drawing Sheet

BRIDGE CRANE, ESPECIALLY A CONTAINER-LOADING BRIDGE

PRIOR APPLICATIONS

This application is a §371 U.S. National Phase application which bases priority on International Application No. PCT/DE00/01842, filed Jun. 7, 2000, which in turn bases priority on German Application No. DE 199 26 182.2, filed Jun. 9, 1999.

BACKGROUND OF THE INVENTION

1. Field of Invention

The invention relates to a bridge crane having a portal, a boom, a track system laid on the boom and crane trolleys which travel on the tracks.

2. Description of the Prior Art

The problem arises with bridge cranes, particularly container loading bridges, such as are more particularly used for loading and unloading container ships, that if there is only a single track, it is only possible to use in unhindered manner a single trolley. This considerably restricts the capacity of such bridge cranes.

German utility model DE 197 03 282 A1 discloses a container loading bridge in which, besides the working track which guides the trolley extending transversely to said track when the trolley is carrying a load, has a return track comprising a single rail and running laterally alongside the same, and on which the crane trolley extends longitudinally to the direction of travel, the wheel suspension mechanism of the crane trolleys being rotatable about a vertical axis in order to permit the change from the longitudinal orientation to the transverse orientation.

The known system is advantageous compared with the hitherto known proposals, but suffers from the disadvantage that as a result of the use of a single rail for the return track, problems can arise with respect to the running stability.

The problem of the invention is to improve the system known from German Utility Model DE 197 03 282 A1 with respect to the running stability of the crane trolleys to be returned.

SUMMARY OF THE INVENTION

According to the invention, this problem is solved by the features of claim 1. Claim 2 gives advantageous developments of the invention.

The invention is described in greater detail hereinafter relative to two drawings of two embodiments of the track system in diagrammatic form. With regards to other details of the bridge crane construction, reference is made to German Utility Model DE 197 03 282 A1.

DESCRIPTION OF THE DRAWINGS

Further advantages and features of the invention can be gathered from the following description of a preferred embodiment of the invention with reference to the attached drawings, wherein.

DETAILED DESCRIPTION OF THE PREFERRED EMBODIMENTS

Figure 1:
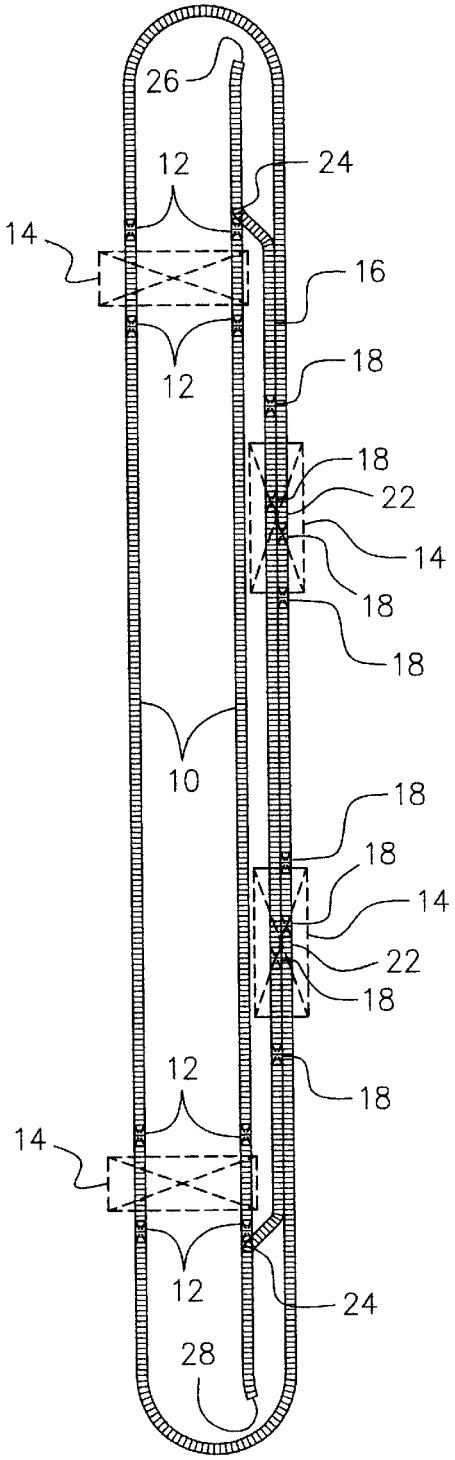
FIG. 1 shows a bridge crane according to the preferred embodiment of the subject invention with an elongated track construction utilizing switch points.

The track system comprises a working track 10, whose two rails have a mutual spacing corresponding to the wide spacing of the running wheels 12 of the crane trolleys 14 in a working position, a return track 16, whose two rails have a mutual spacing corresponding to the narrow spacing of the running wheels 18 of the crane trolleys in a return position, as well as two arched pieces 19 and 20 located in the vicinity of the ends of a boom, where the working track 10 and return track 16 merge into one another. In order to permit a return of the crane trolleys 14 on the narrow return track 16, a two wheel suspension mechanism of the trolleys 14 are freely rotatable about a vertical axis 22. In addition, two rotation axes of the crane trolleys are positioned with respect to a longitudinal axis thereof with a section corresponding to half the mutual spacing of the two rails of the return track 16, so that the crane trolleys 14 on the return track 16 extend longitudinally with respect to the latter (without such a displacement, the trolleys 14 would be inclined with respect to the return track 16).

In the embodiment shown in FIG. 1, the inside rail of the two rails of the working track 10 has a substantially elongated construction. In the vicinity of opposed ends 26 and 28 of said rail and spaced from the ends 26 and 28 switch points 24 are provided, which connect the inner rail of the working track 10 with the inner rail of the return track 16.

Figure 2:
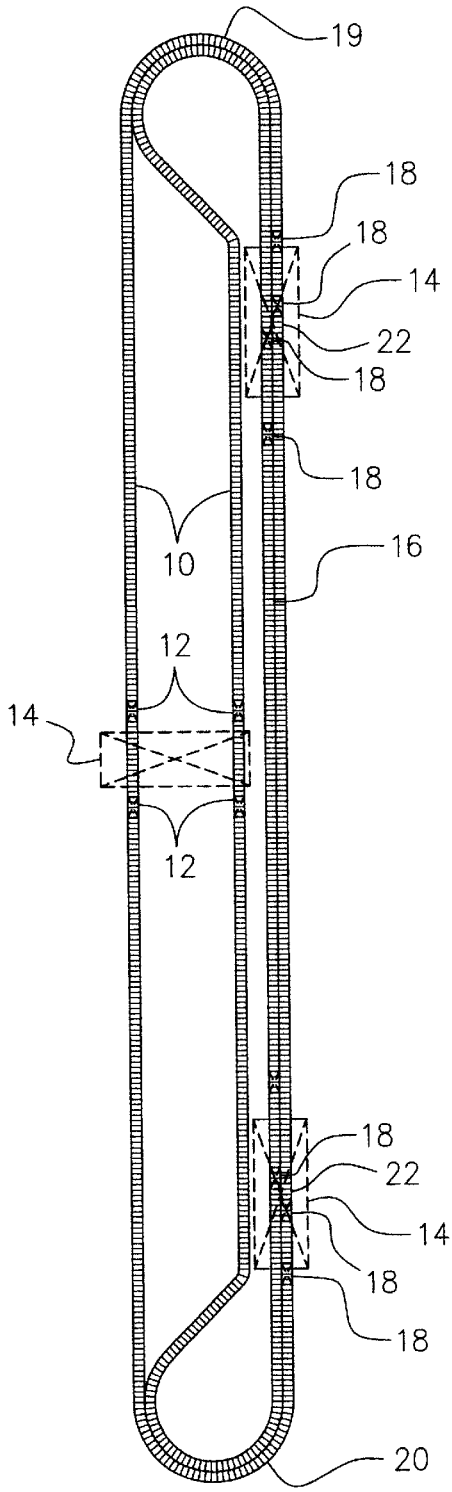
FIG. 2 shows an alternate embodiment of the subject invention without switch points wherein a loop track construction is employed.

In the embodiment shown in FIG. 2, the inner rail of the working track at the two ends of the boom, and without switch points, passes by means of a loop into the inner rail of the return track 16.

What is claimed is:

1. A bridge crane track system for permitting a crane trolley to move along the track system, the crane trolley having a set of running wheels engaging the bridge crane track system, the bridge crane track system comprising:

a) a working track having a first and a second rail member positioned in a spaced apart and parallel relationship, the set of running wheels of the crane trolley traveling along the working track first and second rail members in a first direction, b) a return track having a first and a second rail member positioned in a juxtaposed and parallel relationship to each other, the set of running wheels of the crane trolley traveling along the return track first and second rail members in a second direction opposed from that of the first direction, c) an arched piece of track positioned at each opposed end of the track system connecting the working track and return track; and d) the crane trolley positioned transversely with respect to the working track when traveling thereon and longitudinally with respect to the return track when traveling thereon.

2. The bridge crane track system according to claim 1, wherein the second rail member of the working track is an inner rail.

3. The bridge crane track system according to claim 2, wherein the working track inner rail is substantially elongated and has a pair of opposed terminal ends.

4. The bridge crane track system according to claim 3, wherein the second rail member of the return track is an inner rail having a pair of opposed angled portions which connect to portions of the working track inner rail at a position proximal to the opposed terminal ends thereof.

5. The bridge crane track system according to claim 4, wherein a pair of switching points are provided which facilitate the connection between the working track inner rail and the return track inner rail.

6. The bridge crane track system of claim 1, wherein the working track first rail member and the return track first rail member are connected to one another.

7. The bridge crane track system of claim 6, wherein the working track first rail member and the return track first rail member form a continuous looped single rail member of the bridge crane track system.

8. The bridge crane track system of claim 7, wherein the continuous looped single rail member of the bridge crane track system is oval-shaped.

9. The bridge crane system of claim 1, wherein the second rail member of the working track is a first inner rail and the second rail member of the return track is a second inner rail, the first and second inner rails connected to one another as an inner continuous single rail member of the bridge crane track system.

10. The bridge crane system of claim 9, wherein the inner continuous single rail member of the bridge crane track system has a pair of elongated substantially parallel rail portions and a pair of opposed tear drop-shaped end portions.

11. The bridge crane system of claim 10, wherein the working track first rail member and the return track first rail member are connected to one another as an oval-shaped outer continuous single rail member.

12. The bridge crane system of claim 11, wherein the opposed tear drop-shaped end portions of the inner continuous single rail member are each positioned juxtaposed to opposed end portions of the oval-shaped outer continuous single rail member.

* * * * *